US009462930B2

(12) United States Patent
Bastuji et al.

(10) Patent No.: US 9,462,930 B2
(45) Date of Patent: Oct. 11, 2016

(54) DISHWASHER WITH A DEVICE FOR ASSEMBLING THE BASKET TO THE EXTRACTING RAIL

(75) Inventors: Cem Bastuji, Istanbul (TR); Ertugrul Sencan, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 1537 days.

(21) Appl. No.: 12/990,780

(22) PCT Filed: Apr. 22, 2009

(86) PCT No.: PCT/EP2009/054831
§ 371 (c)(1),
(2), (4) Date: Jan. 24, 2011

(87) PCT Pub. No.: WO2009/133007
PCT Pub. Date: Nov. 5, 2009

(65) Prior Publication Data

US 2011/0114138 A1 May 19, 2011

(30) Foreign Application Priority Data

May 2, 2008 (TR) ..... a 2008/03066

(51) Int. Cl.
*A47L 15/50* (2006.01)
*A47B 96/06* (2006.01)

(52) U.S. Cl.
CPC ..... *A47L 15/507* (2013.01); *A47B 96/061* (2013.01)

(58) Field of Classification Search
CPC .. A47L 15/504; A47L 15/507; A47B 96/061
USPC ..... 134/56 D, 57 D, 58 D, 135, 137, 151
See application file for complete search history.

(56) References Cited

U.S. PATENT DOCUMENTS

| | | | | |
|---|---|---|---|---|
| 3,744,646 | A * | 7/1973 | Duncan | A47L 15/507 211/151 |
| 4,340,144 | A * | 7/1982 | Cousins | A47F 5/083 211/106 |
| 4,449,765 | A * | 5/1984 | Lampman | A47L 15/507 16/267 |
| 5,474,378 | A | 12/1995 | Smith et al. | |
| 6,189,847 | B1 * | 2/2001 | Hart | 248/220.31 |
| 7,418,967 | B2 * | 9/2008 | Kim | 134/57 D |
| 7,887,027 | B2 * | 2/2011 | Garceau et al. | 256/1 |
| 2004/0103932 | A1 * | 6/2004 | Kim | 134/137 |
| 2005/0133469 | A1 * | 6/2005 | Mersch et al. | 211/41.8 |

FOREIGN PATENT DOCUMENTS

| | | | |
|---|---|---|---|
| DE | 102006055349 | | 3/2008 |
| EP | 1854394 | A1 * | 11/2007 |
| FR | 2077852 | A | 11/1971 |

OTHER PUBLICATIONS

International Search Report, mailing date Aug. 24, 2009, for corresponding International Application No. PCT/EP2009/054831.

* cited by examiner

*Primary Examiner* — Michael Barr
*Assistant Examiner* — Kevin G Lee
(74) *Attorney, Agent, or Firm* — Kilpatrick Townsend & Stockton LLP

(57) ABSTRACT

The present invention relates to a dishwasher (1) wherein the assembly of the connection member (8) on the basket (3) side walls (5) can be made easily and robustly by passing through the basket (3) thereby supporting the wheels (9) mounted in the rails (7) disposed on the side walls of the washing chamber (2) and maintaining the basket (3) to be emplaced into the washing chamber (2) and drawn out therefrom by moving forwards, backwards in the rails (7).

9 Claims, 4 Drawing Sheets

DISHWASHER WITH A DEVICE FOR ASSEMBLING THE BASKET TO THE EXTRACTING RAIL

CROSS-REFERENCE TO RELATED APPLICATIONS

Figure 1:
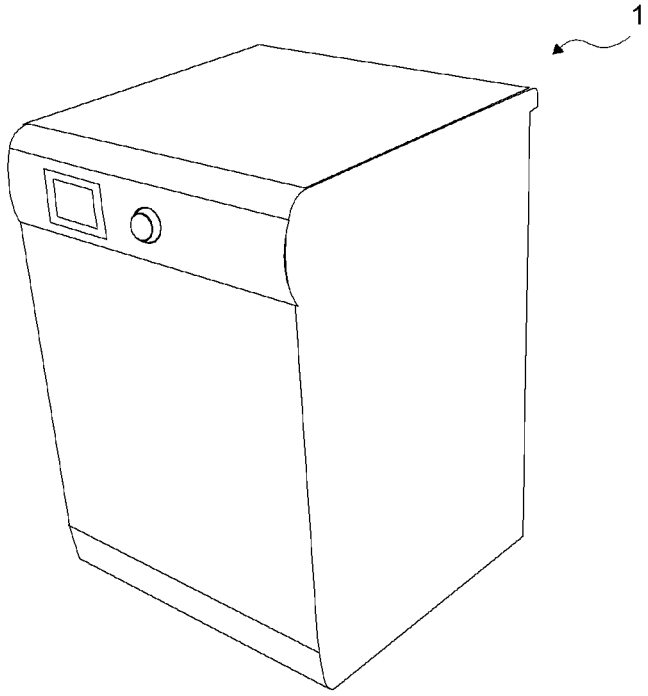

This application is a U.S. National Phase application, under 35 U.S.C. §371, of International Application no. PCT/EP2009/054831, with an international filing date of Apr. 22, 2009 and claims benefit of Turkish Application no. A 2008/03066 filed on May 2, 2008, and which are hereby incorporated by reference for all purposes.

DESCRIPTION

The present invention relates to a dishwasher comprising a basket wherein items to be washed are emplaced.

Dishwashers comprise upper and lower baskets wherein kitchenware items such as pots and plates can be emplaced. Kitchenware is loaded into or unloaded from each basket by moving the basket outwards from the washing chamber.

The wheels that aid the basket to be placed into the washing chamber or to be moved outward therefrom can be assembled on the basket by numerous different methods. Nowadays, the assembly parts used in assembling the wheels on the basket are mostly made of plastic. The plastic assembly parts, together with its many benefits also have a lot of disadvantages. The plastic assembly parts, not having much mechanical strength, yield under load and lead to problems of the loaded basket not being parallel to the floor when pulled out due to the yield.

In the state of the art U.S. Pat. No. 4,449,765, wheel mounts are arranged to be mounted to portions of the dishrack facilitating forward, backward movement of the dishrack on horizontal tracks situated on the sidewalls of the dishwashing space in the dishwasher.

The aim of the present invention is the realization of a dishwasher wherein the wheels maintaining movement of the basket are assembled easily and robustly to the basket.

The dishwasher realized in order to attain the aim of the present invention is explicated in the claims.

The dishwasher of the present invention comprises at least two connection members that support the wheels mounted to the rails on the side walls of the washing chamber. The connection members are assembled on the opposite side walls of the basket.

The connection member comprises two channel shaped vertical retainers, extending parallel to each other, with their orifices facing different directions and a channel shaped horizontal retainer extending perpendicular to the said vertical retainers. The connection member is fastened to the side wall of the basket by passing through the basket, surrounding the vertical wires via the vertical retainers, with orifices facing different directions, and surrounding a horizontal wire by the horizontal retainer. As the connection member is assembled by passing through the basket, the washing volume is increased since an additional space is not left between the basket and the washing chamber for the connection member.

In the preferred embodiment of the present invention, a certain distance is provided between the two wheels disposed one above and one below on each connection member. The height of the basket in the washing chamber is changed depending on seating the upper or lower wheels on the rails. Accordingly, a height adjustable basket is provided in the washing chamber by means of two wheels, one above and one below, supported by each connection member assembled on the opposite side walls of the basket.

The channel shaped vertical retainer which has side walls positioned parallel to the side walls of the washing chamber is configured rigidly. Since the vertical retainer, produced integrated with the connection member, is configured rigidly, the forces from the basket towards the oppositely facing walls of the washing chamber and the turning moments at the rail axis are counterbalanced more strongly.

In the preferred embodiment of the present invention, the rigidly configured vertical retainer is multi-pieced. The vertical retainer being multi-pieced provides ease of production and also convenience in assembling the connection member to the basket.

The channel shaped vertical retainer, with an orifice facing one of the washing chamber walls, comprises resilient lugs on one of its inner lateral surfaces. The wire emplaced in the vertical retainer is virtually surrounded all around by means of the resilient lugs, maintaining the connection member to be tightly fitted to the basket. Moreover, the forces formed from the basket towards the walls of the washing chamber facing each other and in the reverse direction are also counterbalanced.

In the preferred embodiment of the present invention, the connection member comprises a plate shaped body and an extension that is almost on the same plane as the body and two wheels, one disposed on the body and the other one on the extension. The channel shaped horizontal retainer between the body and the extension is passed from the wires forming the side walls of the basket to the horizontal wire. Thus the connection member is tightly fastened to the basket in the vertical axis. Moreover, by positioning the horizontal retainer almost at the center of the connection member, the forces and moments acting on the connection member are distributed and supported more homogeneously.

A dishwasher realized in order to attain the aim of the present invention is illustrated in the attached figures, where:

FIG. 1—is the perspective view of a dishwasher.

Figure 2:
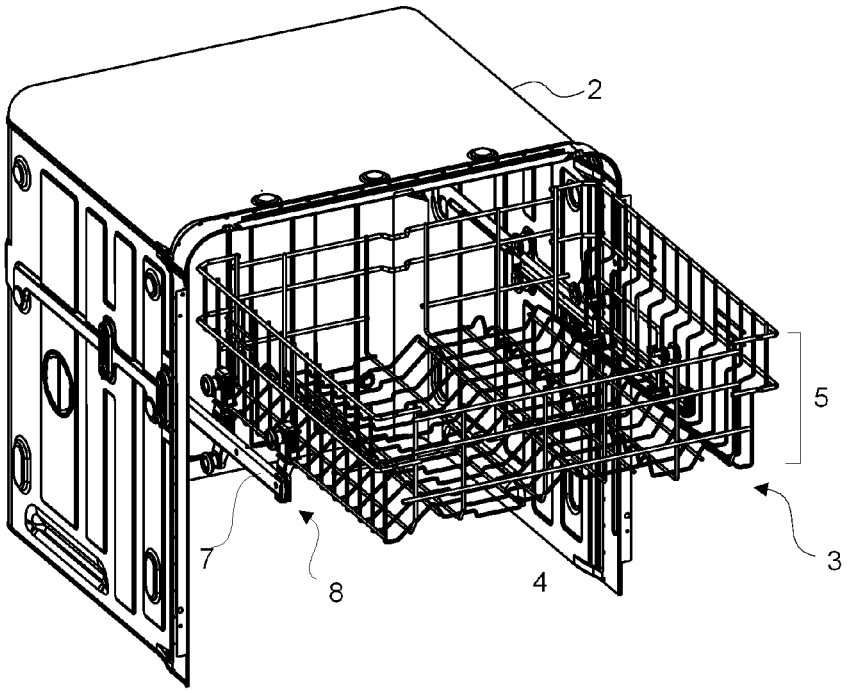

FIG. 2—is the perspective view of a washing chamber and a basket.

Figure 3:
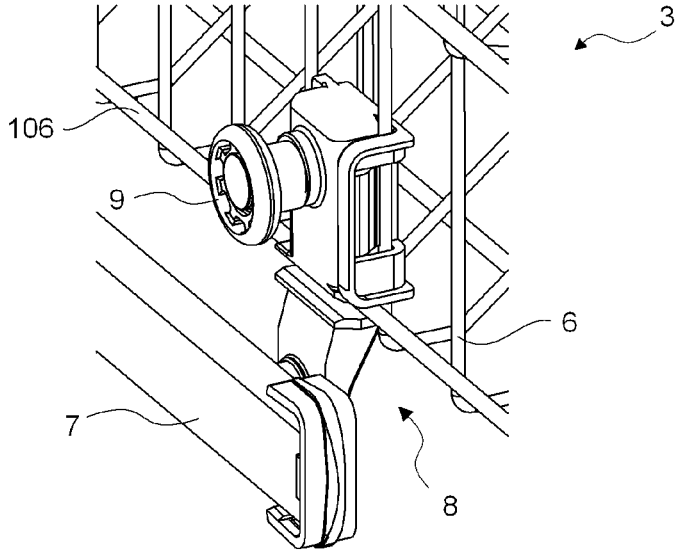

FIG. 3—is the detailed view of a connection member assembled to the basket and the rail.

Figure 4:
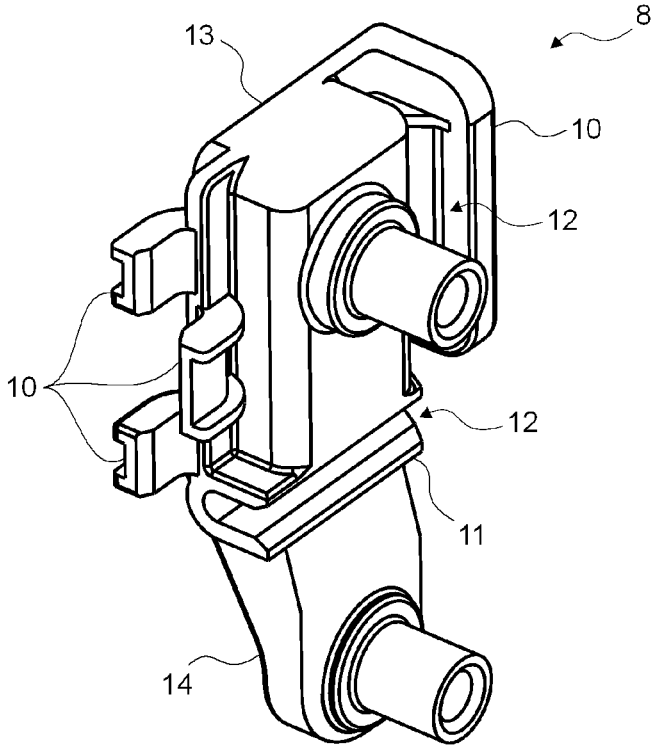

FIG. 4—is the perspective view of a connection member.

Figure 5:
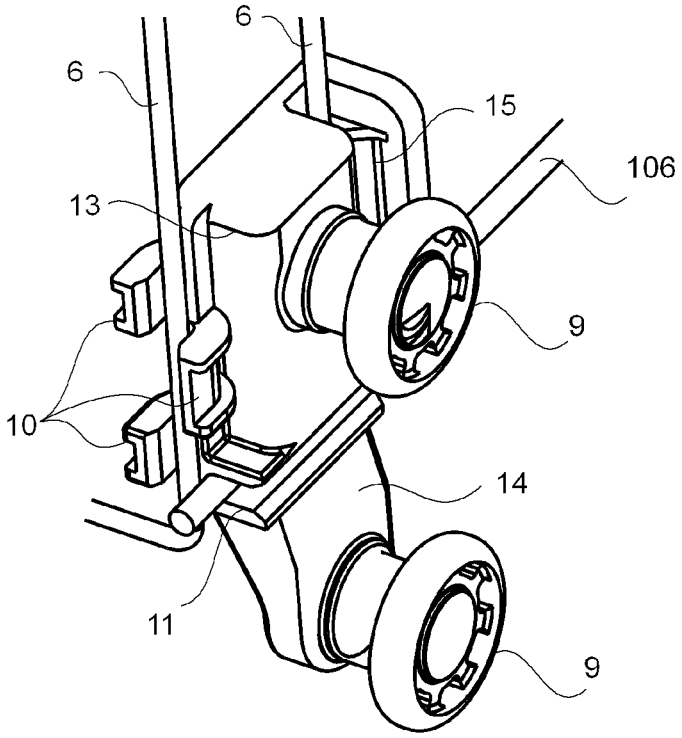

FIG. 5—is the perspective view of a connection member assembled to the basket side wall.

Figure 6:
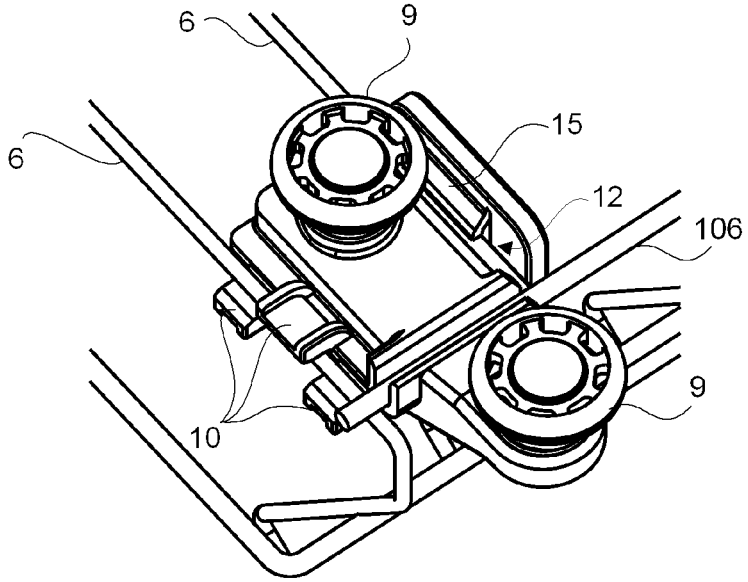

FIG. 6—is the perspective view of a connection member assembled to the basket side wall from another angle.

Figure 7:
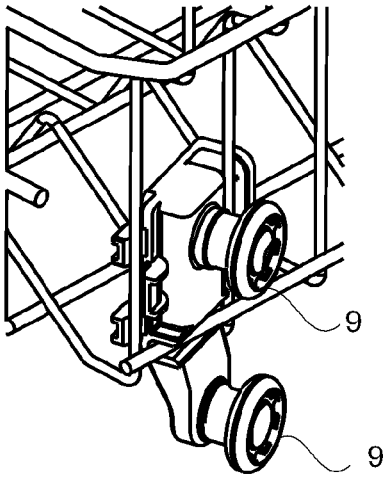

FIG. 7—is the perspective view of a connection member while being assembled to the basket.

Figure 8:
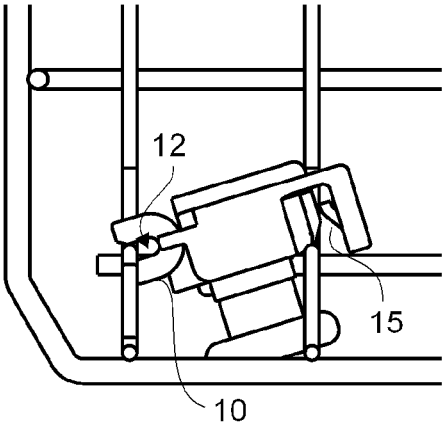

FIG. 8—is the top view of a connection member while being assembled to the basket.

Figure 9:
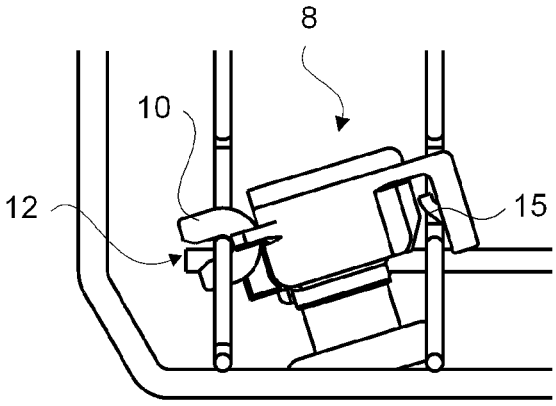

FIG. 9—is another top view of a connection member while being assembled to the basket.

Figure 10:
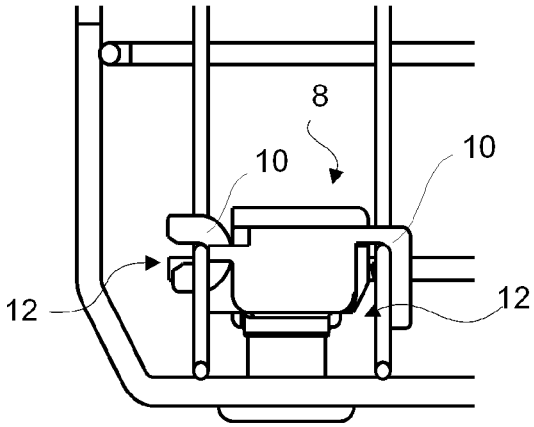

FIG. 10—is the top view of a connection member assembled to the basket.

The elements illustrated in the figures are numbered as follows:

1. Dishwasher
2. Washing chamber
3. Basket
4. Base
5. Side wall
6. 106. Wire
7. Rail
8. Connection member
9. Wheel
10. Vertical retainer

11. Horizontal retainer
12. Orifice
13. Body
14. Extension
15. Lug The dishwasher (1) of the present invention comprises a washing chamber (2) wherein the washing process is performed, a base (4) and a basket (3) having side walls (5) formed of horizontal and vertical wires (106, 6) enclosing the base (4), wherein items to be washed are emplaced, two rails (7) disposed oppositely on the side walls of the washing chamber (2), at least two connection members (8) assembled on the wires (6, 106) arranged on two opposite side walls (5) of the basket (3) and at least one wheel (9) situated on each connection member (8), seated in the rails (7), maintaining the basket (3) to be emplaced into the washing chamber (2) and to be drawn out by moving forwards and backwards in the rails (7) (FIG. 1, FIG. 2 and FIG. 3).

The connection member (8) comprises two parallel vertical retainers (10) having orifices (12) facing directions perpendicular to each other, wherein the vertical wires (6) are seated and a horizontal retainer (11) that extends perpendicularly thereto, wherein the horizontal wire (106) is seated (FIG. 4).

The vertical retainers (10) are positioned on the connection member (8) to be parallel to each other and the orifices (12) facing directions perpendicular to each other. One of the vertical retainers (10) has an orifice (12) facing one of the washing chamber (2) side walls and the orifice (12) of the other vertical retainer (10) is perpendicular to that. Accordingly, the walls of the said vertical retainer (10) are parallel to the side walls of the washing chamber (2) (FIG. 4).

In the preferred embodiment of the present invention, the dishwasher (1) comprises at least two wheels (9) disposed one above and one below on the connection member (8) having a certain distance therebetween in the vertical direction. The height of the basket (3) in the washing chamber (2) can be changed depending on seating the upper or the lower wheel (9) on the rails (7) (FIG. 5).

The channel shaped vertical retainer (10) is configured rigidly, having side walls positioned parallel to the side wall of the washing chamber (2). The vertical retainer (10), produced integrated with the connection member (8), serves as a support due to its rigid configuration. Accordingly, the forces from the washing chamber (2) side walls in the perpendicular direction into the basket (3) and the forces formed in the opposite direction are counterbalanced more strongly (FIG. 5).

The vertical retainer (10), with an orifice facing the washing chamber (2) wall, comprises at least one resilient lug (15) that partially covers the orifice (12). The vertical wire (6) emplaced in the vertical retainer (10) is virtually surrounded all around by means of the lugs (15), thereby maintaining the connection member (8) to be tightly fitted to the basket (3) (FIG. 5 and FIG. 6).

The connection member (10) that is connected to the wires (6, 106) forming the side wall (5) of the basket (3) by passing through the basket (3), surrounds to hold on to the wires (6, 106) mounted thereto by means of the channel shaped configuration of the vertical retainers (10) and the horizontal retainer (11). First the connection member (8) is passed through the basket (3) and the rigidly configured vertical retainer (10) is connected to one of the vertical wires (6) forming the side wall (5) of the basket (3). Afterwards, the connection member (8) is mounted on the basket (3) by rotating clockwise such that the vertical retainer (10) having resilient lugs (15) clasps one vertical wire (6) and the horizontal retainer (10) simultaneously clasps one horizontal wire (106). The connection member (8) is assembled tightly on the basket (3) due to the rigidly configured vertical retainer (10) and the resilient lugs (10) (FIG. 7, FIG. 8, FIG. 9 and FIG. 10).

The connection member (8) furthermore comprises a plate shaped body (13) and an extension (14) under the body (13) situated at the same plane as thereof. The wheels (9), one being on the body (13) and the other on the extension (14) are mounted one over the other. A certain distance is provided between the wheels (9) such that the position of the basket (3) can be changed in the washing chamber (2). The basket (3) is in the highest possible position in the washing chamber (2) when the wheel (9) on the extension (14) is disposed between the rails (7). When the basket (3) height is desired to be changed, the basket (3) is taken out of the washing chamber (2), the wheel (9) situated on the body (13) of the connection member (8) is mounted to the rails (7), whereby the basket (3) is positioned at a lower level in the washing chamber (2) (FIG. 3). Consequently, a height adjustable basket (3) is provided by means of two wheels (9) situated one over the other on a single connection member (8).

In this embodiment, the vertical retainers (10) are disposed on two sides of the body (13) and the horizontal retainer (11) between the body (13) and the extension (14).

In an embodiment of the present invention, the orifice (12) of the channel shaped horizontal retainer (11) faces one of the washing chamber (2) side walls.

In the preferred embodiment of the present invention, the rigidly configured vertical retainer (10) has multi-pieced side walls.

By means of the present invention, the assembly of the connection member (8) on the basket (3) side walls (5) can be made easily and robustly thereby supporting the wheels (9) mounted in the rails (7) disposed on the side walls of the washing chamber (2) thereby maintaining the basket (3) to be emplaced into the washing chamber (2) and drawn out therefrom by moving forwards, backwards in the rails (7).

The invention claimed is:

1. A dishwasher comprising: a washing chamber wherein a washing process is performed, and a basket, the basket having side walls formed of a plurality of horizontal and vertical wires enclosing a base, wherein items to be washed are placed, a pair of rails oppositely disposed on washing chamber's side walls, at least two connection members mounted on the plurality of horizontal and vertical wires, each connection member arranged on an opposite side wall of the basket and having at least one wheel situated on each connection member, the connection wheels seated in the rails, maintaining the basket placement into the washing chamber and the basket is drawn out by moving forward and backwards in the rails and characterized by each connection member having: two parallel vertical retainers with orifices facing directions perpendicular to each other, wherein the plurality of vertical wires are seated, and a horizontal retainer that extends perpendicularly to the vertical wires, wherein the horizontal wire is seated; and wherein the two parallel vertical retainers are channel shaped, the orifice of one vertical retainer faces the washing chamber side wall closest thereto and the orifice of the other vertical retainer faces toward a door; and wherein the horizontal retainer includes an orifice facing one of the washing chamber side walls closest thereto; wherein the connection member is mounted to the inner side of the basket by connecting the other vertical retainer to one vertical wire and rotating the connection member toward the washing chamber side wall such that the one vertical retainer and the horizontal retainer clasp another vertical wire and the horizontal wire, respectively.

2. The dishwasher as in claim 1, characterized by at least two wheels disposed one over the other on each connection member, having a certain distance therebetween in the vertical direction.

3. The dishwasher as in claim 1, characterized by each channel shaped vertical retainer, rigidly configured, having walls extending parallel to the side walls of the basket, and surrounding a vertical wire placed therein from the sides.

4. The dishwasher as in claim 1, characterized by each connection member comprising a plate shaped body and an extension under the body that is almost on a same plane as the body.

5. The dishwasher as in claim 4, characterized by each connection member comprising the two vertical retainers disposed on two sides of the body, and the horizontal retainer being channel shaped and disposed between the body and the extension.

6. The dishwasher as in claim 4, characterized by each of the connection members comprising two wheels, one situated on the body and the other on the extension.

7. The dishwasher as in claim 3, characterized by each vertical retainer having multi-pieced side walls.

8. The dishwasher as in claim 1, characterized by one of the vertical retainers with an orifice which faces one of the side walls, comprising at least one resilient lug that partially covers the orifice.

9. A dishwasher comprising: a washing chamber wherein a washing process is performed, and a basket, the basket having side walls formed of a plurality of horizontal and vertical wires enclosing a base, wherein items to be washed are placed, a pair of rails oppositely disposed on the washing chamber's side walls, at least two connection members mounted on the plurality of horizontal and vertical wires, each connection member arranged on an opposite side wall of the basket and having at least one wheel situated on each connection member, the connection wheels seated in the rails, maintaining the basket placement into the washing chamber and the basket is drawn out by moving forward and backwards in the rails and characterized by each connection member having: two parallel vertical retainers with orifices facing directions perpendicular to each other, wherein the plurality of vertical wires are seated, and a horizontal retainer that extends perpendicularly to the vertical wires, wherein the horizontal wire is seated; and wherein the two parallel vertical retainers are channel shaped and the orifice of one vertical retainer faces away from the basket and the orifice of the other vertical retainer faces an opening of the washing chamber; wherein items are to be washed are placed, that is enclosing the base, and wherein the horizontal retainer includes an orifice facing away from the basket, wherein items are to be washed are placed, that is enclosing the base, wherein the connection member is mounted to the inner side of the basket by connecting the other vertical retainer to one vertical wire and rotating the connection member toward the washing chamber side wall such that the one vertical retainer and the horizontal retainer clasp another vertical wire and the horizontal wire, respectively.

* * * * *